US007030822B1

(12) United States Patent
Grabowski

(10) Patent No.: US 7,030,822 B1
(45) Date of Patent: Apr. 18, 2006

(54) ANTENNA MOUNTING BRACKET FOR PICKUP TRUCKS

(76) Inventor: Eric John Grabowski, P.O. Box 6127, Kamuela, HI (US) 96743-6127

( * ) Notice: Subject to any disclaimer, the term of this patent is extended or adjusted under 35 U.S.C. 154(b) by 0 days.

(21) Appl. No.: 10/916,788

(22) Filed: Aug. 11, 2004

Related U.S. Application Data

(60) Provisional application No. 60/494,987, filed on Aug. 13, 2003.

(51) Int. Cl.
*H01Q 1/32* (2006.01)

(52) U.S. Cl. ..... 343/715; 343/713; 248/539

(58) Field of Classification Search ..... 343/715; 248/539
See application file for complete search history.

(56) References Cited

U.S. PATENT DOCUMENTS

| | | | | |
|---|---|---|---|---|
| 4,110,757 | A * | 8/1978 | Sieber | 343/715 |
| 4,114,160 | A * | 9/1978 | Verini | 343/715 |
| 4,151,533 | A * | 4/1979 | Vogt | 343/715 |
| 4,158,844 | A * | 6/1979 | Wood | 343/715 |
| 4,161,735 | A * | 7/1979 | Zylla | 343/713 |
| 5,020,765 | A * | 6/1991 | Evans et al. | 248/539 |

* cited by examiner

*Primary Examiner*—Tho Phan

(57) ABSTRACT

A robust antenna mounting bracket suitable for mounting a variety of high-frequency, very-high-frequency, and ultra-high frequency communications antennas to the bed of a pickup truck. The bracket, which is made from a single piece of metal, consists of a horizontal platform, which accepts a wide variety of antenna bases, a vertical panel, which transfers the force due to the weight of the antenna to a stake pocket housing, and a leg, which connects the platform to the foot and causes the platform to be located behind the rear fender of a pickup truck.

7 Claims, 4 Drawing Sheets

ANTENNA MOUNTING BRACKET FOR PICKUP TRUCKS

CROSS-REFEFERENCE TO RELATED APPLICATIONS

Provisional Patent Application, application No. 60/494,987, filing date Aug. 13, 2003, confirmation number 8699, filing receipt *OC000000011231354.

FEDERALLY SPONSORED RESEARCH

Not Applicable

SEQUENCE LISTING OR PROGRAM

Not Applicable

BACKGROUND OF THE INVENTION

1. Field of Invention

This invention relates to an antenna mounting bracket, specifically to such a bracket used to mount a communications antenna to the bed of a pickup truck.

2. Prior Art

Although a communications antenna can be mounted to a pickup truck in a variety of ways, every one of them currently in use has one or more significant shortcomings or distinct disadvantages associated with it. These limitations can be grouped into three general categories: functional limitations, mechanical limitations, and cosmetic limitations.

The chief functional limitation is one of poor overall antenna system performance due to restrictions imposed by the method used to mount it. Evidence of such performance degradation is easily measured and is well documented in the literature. Primarily, the performance degradation manifests itself in two ways: the appearance of irregular fluctuations in the voltage standing wave ratio; and, distortion in the radiation field pattern.

There are two chief mechanical limitations. The first one relates to the base of the antenna. Here, the problem is rooted in the fact that there are many different styles of antenna bases commercially available today and they are not compatible with one another. Some antenna bases are limited to supporting only short and light-weight communications antennas, i.e., only those antennas useful in the very-high-frequency band and above, while others are limited to supporting only long communications antennas, i.e., those primarily used in the high-frequency band, the lower portion of the very-high-frequency band, and occasionally other portions of the very-high-frequency and ultra-high-frequency bands of the electromagnetic spectrum. In addition, some of them are limited by their application, i.e., they require a stake pocket located on the bed-rail of a pickup truck, or a hole of a particular dimension in a roof, fender, bed-rail, bumper, or other relatively horizontal and/or flat mounting surface.

The second major mechanical limitation relates to the lack of compatibility with other accessory items in wide-spread use on pickup trucks, e.g., truck caps, camper conversions, utility racks, and the like.

Finally, most of the mounting methods currently in use today have a cosmetic disadvantage associated with them because they require one or more holes be made in the vehicle's roof, fender, bed, or bumper in order to accommodate the antenna base. Thus, using any one of these mounting methods results in an irreversible modification to the vehicle which decreases not only its resale potential but its resale value as well.

The following paragraphs identify the most popular mounting methods currently being used to attach communications antennas to pickup trucks and summarize the limitations of each. The first three methods described below are particularly well-suited for use on pickup trucks while the remainder are more general and apply to many other vehicle styles besides trucks.

Ball and Spring: The ball and spring mounting method requires multiple holes, usually one large and three small, be made in the side of the cabin, the side of the bed, or in the rear bumper of the vehicle. This is by far the most popular method of mounting a communications antenna for the high-frequency band or lower portion of the very-high-frequency band to a pickup truck. That said, the ball and spring mounting method has a number of performance, mechanical, and cosmetic limitations. The most significant of these disadvantages are described below.

The complex load impedance that the antenna presents to a transmitter connected to it varies in an unpredictable way whenever the antenna is out of plumb. This is due to an adverse capacitive interaction set up by the proximity of the vehicle's body to the antenna, particularly the portion of the antenna closest to the base. Such erratic behavior, which is observed when the vehicle is in motion or the antenna sways for any reason, may cause the transmitter to reduce the amount of power it delivers to the antenna, shut down temporarily, or fail entirely.

The radiation field pattern is skewed from the preferred and highly desirable omni-directional pattern to favor a particular direction at the expense of another. This is due to several adverse effects the vehicle's body has upon the antenna and is especially apparent when the antenna base is mounted on or near the vehicle's bumper. This anomaly may cause difficulty communicating with stations not located in the favored direction.

The variety of commercially available communications antennas that can be used with the ball and spring mounting method is quite limited. Although it is used almost exclusively for high-frequency antennas, there are relatively few antennas for the very-high-frequency band and above that are compatible with it.

When the antenna base is mounted on the vehicle's bumper, it is not uncommon for the antenna to make physical contact with the truck's bed when the vehicle is in motion unless some extraordinary protective measures are taken to prevent it. This type of anomaly can cause permanent damage to the transmitter connected to the antenna as well as physical damage to the antenna and the vehicle.

The installation and use of accessory items commonly used in conjunction with pickup trucks, such as truck caps, camper conversions, utility racks, and so on is problematic because the antenna physically interferes with these items. Thus, the installation of a communication antenna can preclude the use of these highly desirable and popular accessories or vice versa.

Finally, the wholesale and retail value of the vehicle is significantly diminished as a direct result of the holes made in the cabin, bed, or bumper in order to attach a communications antenna using the ball and spring mounting method.

Trailer Hitch: The trailer hitch mounting method consists of a straight metal bar with a hole at either end. The hole at one end is used to attach the bar to a trailer hitch in such a way that the bar is located between the ball and the base of the hitch. The hole at the opposite end is used to attach an antenna base. As a result, the antenna is physically located directly behind the center of the tailgate and only a few inches from it. The adverse performance and mechanical limitations of this mounting method are quite similar to those of the ball and spring mounting method only more severe. In addition, however, because of its location, the antenna physically interferes with the normal operation of the tailgate, i.e., the tailgate cannot be lowered as long as the antenna is attached to the base. Furthermore, the use of short antennas is prohibited because of the severely distorted radiation field pattern that results.

Stake Pocket: The stake pocket mounting method consists of an inverted U-shaped bracket that slides into and is then secured to one of the stake pockets which are an integral part of the bed-rail on pickup trucks. The adverse performance and mechanical limitations of this mounting method are similar to those of the ball and spring mounting method; and, since this mounting bracket uses one of the stake pockets, it absolutely precludes the use of all other accessory items that depend on the availability of the stake pockets for securing them to the bed of the pickup truck. Specifically, this rules out the use of truck caps, utility racks, and camper conversions.

General Automotive: The roof mounting method requires that a hole, usually three-eighths, three-quarters, or seven-eighths of an inch in diameter, be made in a horizontal body surface of the vehicle. On pickup trucks, the hole is usually made in the center of the cabin's roof; but, occasionally, it is made on the top of one of the bed-rails. The performance of roof mounted antennas is excellent; however they do suffer from several mechanical limitations. Camper conversions and utility racks extend over the roof and are therefore a source of physical interference. Bed-rails are not always parallel to the ground and mounting an antenna on a sloped bed-rail causes it to be out of plumb. Not only is the result aesthetically unpleasing but the radiation pattern is adversely affected. The pattern is also distorted by an asymmetric ground plane and the proximity of the antenna to the cabin. The maximum distance over which communications is possible is reduced because the antenna is physically lower than when it is roof mounted. In addition, this mounting method is only suitable for use with antennas that are short and lightweight, i.e., antennas used for the very-high-frequency band and above. Specifically, this mounting method is not suitable for use with antennas that are long, i.e., antennas used for the high-frequency bands. Finally, the unavoidable and unsightly mounting hole has an adverse impact on the vehicle's worth.

The cowl mounting method requires that a hole, typically three-eighths, three-quarters, or seven-eighths of an inch in diameter, be made in a fender of the vehicle, usually near the cowl but possibly on a bed-rail of a pickup truck. The adverse performance and mechanical limitations of this mounting method are quite similar to those of the ball and spring mounting method. In addition, since many vehicle manufacturers prefer to locate on-board computers in the cowl area of the cabin, installing a communication antenna on the cowl may significantly enhance the opportunity for radio frequency interference to occur. This unintentional and adverse interaction may take the form of signals radiating from the on-board computer interfering with the communications equipment, signals radiating from the communications equipment interfering with the on-board computer, or, more than likely, a combination of the two. Furthermore, the cowl mounting method is only suitable for use with short, light-weight antennas. It is not suitable for use with long antennas, i.e., those antennas used in the high-frequency bands. Finally, the unavoidable and unsightly mounting hole has an adverse impact on the vehicle's worth.

The trunk lip mounting method consists of an L-shaped metal bracket with multiple holes in one side and a single hole in the other. The multiple holes are used to attach the bracket to the inside lip of the trunk by means of sheet-metal screws. The hole at the opposite end is used to attach the antenna base. This type of mounting bracket accommodates most antenna bases designed for roof or cowl mounting. On pickup trucks, it is most frequently used to attach the antenna base to the hood as opposed to a trunk; however, it is sometimes used to attach the base of an antenna to one of the bed-rails. The single advantage of the trunk lip mounting method is that it does not require an unsightly hole in an exposed body panel. The adverse performance and mechanical limitations of this mounting method are quite similar to those of the cowl mounting method. Furthermore, this method can only be used on hoods of trucks that are not highly stylized, i.e., those on which the hood lines are perpendicular to the grill.

The on-glass mounting method consists of a plastic bracket that attaches the antenna base to one of the vehicle's windows by means of an adhesive substance. The single advantage of the on-glass mounting method is that it does not require an unsightly hole in an exposed body panel. This mounting method suffers from the same adverse performance and mechanical limitations as the cowl mounting method. Furthermore, the performance of on-glass antennas is significantly diminished because the electrical signal is degraded as it passes through tinted glass. In fact, most antenna manufacturers do not recommend the use of on-glass antennas for vehicles equipped with tinted glass windows; and, since most vehicles come factory equipped with tinted windows, this is a major limitation peculiar to this mounting method. Furthermore, when a communication antenna is installed on the front or rear window of a pickup truck it physically interferes with common truck accessories such as camper conversions and utility racks which tend to over hang the roof of the cabin.

The magnetic mounting method uses a magnet to temporarily secure a communications antenna to a vehicle. The sole advantage of this method is that a permanent hole is not required in the vehicle's body surface. This mounting method suffers from the same adverse performance and mechanical limitations as the cowl mounting method. Furthermore, the magnetic mounting method can only be used to attach an antenna to a surface of a vehicle made of ferrous metal. Specifically it cannot be used to attach an antenna to the roof, hood, deck lid, or body panel made of aluminum, fiberglass, or other non-ferrous materials. Since the antenna is not permanently attached to the vehicle, both the antenna and magnetic mount are at risk for casual theft. The magnetic mounting method is primarily suitable for use with short, light-weight antennas, i.e., antennas used for the very-high-frequency band and above. This mounting method is not practical for use with antennas that are long, i.e., antennas used for the high-frequency bands, although at least one manufacturer of such a product makes that claim.

3. Objects and Advantages

Accordingly, several objects and advantages of the antenna mounting bracket are:

(a) to provide a means of mounting a wide variety of communications antennas to the bed of a pickup truck in such a way that the antenna base is located above the horizontal plane of the bed-rails and behind a rear fender of the truck.

(b) to provide a means of mounting a communications antenna to the bed of a pickup truck so that the antenna's radiation pattern and voltage standing wave ratio are not adversely affected by the antenna's proximity to the body of the vehicle.

(c) to provide a means of mounting a communications antenna to the bed of a pickup truck in such a manner that the communications antenna is located as far away as practical from the vehicle's cowl-mounted on-board computer thereby minimizing the opportunity for radio frequency interference, which may occur between the communications equipment and the on-board computer, to occur.

(d) to provide a means of mounting a communications antenna to the bed of a pickup truck in such a manner that the antenna mounting bracket is suitable for use with a wide variety of antennas used for the high-frequency band, very-high-frequency band, and beyond.

(e) to provide a means of mounting a communications antenna to the bed of a pickup truck in such a manner that the antenna mounting bracket is compatible with a wide variety of antenna base styles.

(f) to provide a means of mounting a communications antenna to the bed of a pickup truck in such a way that it does not prohibit or preclude the use of or interfere with the operation of other popular truck accessories like truck caps, camper conversions, utility racks, and the like.

(g) to provide a means of mounting a communications antenna to the bed of a pickup truck in such a manner that no unsightly holes need be made in any outer body panel, thus preserving the wholesale and resale value of the vehicle.

(h) to provide a means of mounting a communications antenna to the bed of a pickup truck in such a manner that it does not require a hole be made in the bed in order to route the feedline to the communications equipment, but, instead, uses the existing gap between the tail-light housing and rear fender for this purpose.

(i) to provide a means of mounting a communications antenna to the bed of a pickup truck in such a manner that the hardware needed to attach the mounting bracket to the bed is concealed from view by locating it in the gap between the tailgate and the inside of the bed.

(j) to provide a means of mounting a communications antenna to the bed of a pickup truck in such a manner that should it become desirable to remove the antenna mounting bracket from the truck, the mounting holes can be easily plugged with sheet metal screws which will be concealed by their location between the tailgate and the bed.

Other objects and advantages are to provide an antenna mounting bracket:

(a) which maximizes antenna performance by mounting the antenna base above the horizontal plane formed by the bed-rails which it turn means that the antenna will always be in the clear.

(b) which places the base of the antenna at a convenient working height so that the antenna may be easily removed from the mount when necessary, i.e., for driving the vehicle through a car wash or into a garage.

(c) which is easily fabricated from a single piece of sheet metal and inexpensive to manufacture.

(d) which has the provision for attaching a ground wire which bonds the radio frequency ground to the vehicle's frame ground thereby improving antenna performance.

(e) which has the provision for attaching a capacitor for the purpose of impedance matching.

(f) which does not require a hole be drilled in the bed to route the ground wire to the truck frame but instead uses the existing gap between the taillight housing and bed for this purpose.

(g) The bracket is easy to install, requiring only a few small holes inside the bed.

(h) The leg of the bracket passes through the existing gap between the tailgate and the bed, which allows the antenna to be mounted behind the bed where it will not interfere mechanically with other pickup truck accessories.

(i) The bracket translates the downward force caused by the weight of the antenna into a horizontal force that the foot of the bracket applies to the existing stake pocket housing; thus, the bracket mounting screws just secure the bracket to the bed, they do not have to bear the entire weight of the antenna.

(j) Since the platform supports the antenna above the taillight housing, the existing gap between the taillight housing and the bed can be used to route the antenna feedline to the communication equipment, which is normally located inside the cabin; thus eliminating the need to cut another hole in the bed in order to route the feedline to the communication equipment.

Further objects and advantages are to provide a method of mounting a variety of different antennas for the high-frequency and very-high-frequency band having a variety of different styles of antenna bases in such a way that the antenna is always mounted in the clear to assure maximum performance. Still further objects and advantages will become apparent from a consideration of the ensuing drawings and description.

SUMMARY

In accordance with the present invention, an antenna mounting bracket for mounting a communications antenna to the bed of a pickup truck comprises a flat piece of metal fabricated into a unique shape such that there exits a rigid horizontal platform which supports an antenna base, a leg which causes the platform to be located behind the truck's rear fender, and a foot which applies the force resulting from the weight of the antenna system to a stake pocket housing, which is an integral part of the pickup truck's bed.

DRAWINGS—FIGURES

DRAWINGS—REFERENCE NUMERALS

Figure 1:
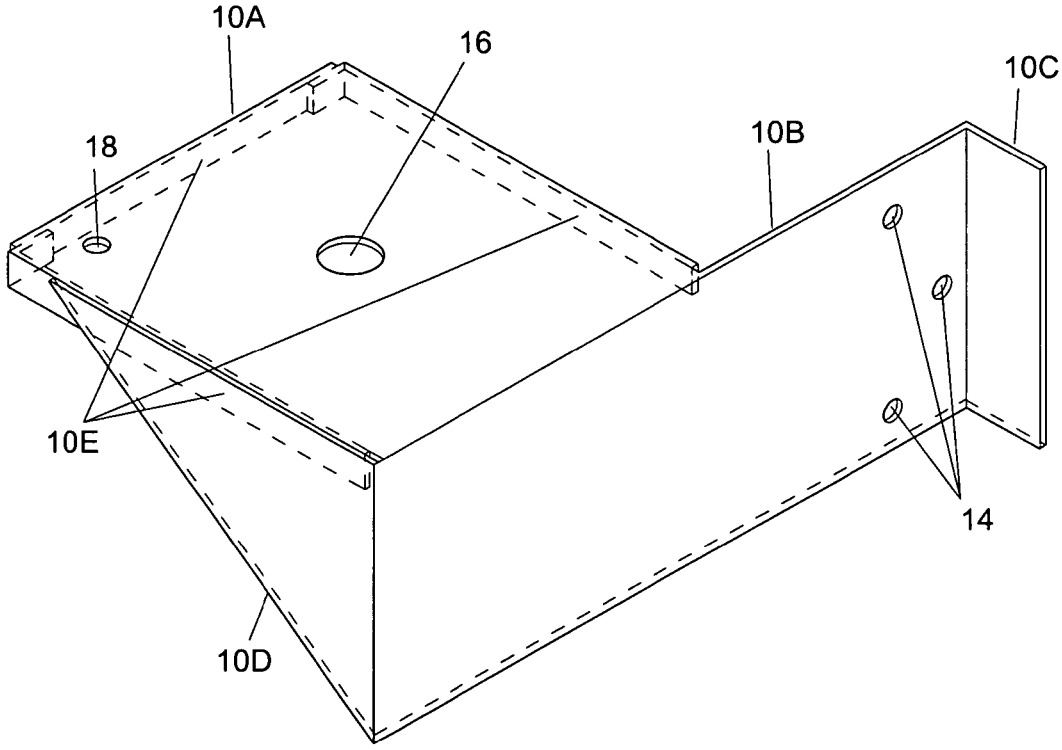
FIG. 1 is a perspective view of the antenna mounting bracket fabricated for use on the left rear fender of the bed of a pickup truck.

10 bracket
10A platform
10B leg
10C foot

10D gusset plate
10E lip
12 pivot point
14 hole, bracket mounting
16 hole, antenna base
18 hole, ground terminal
20 pickup truck bed
22 tailgate latch mechanism
24 tail-light housing
26 stake-pocket housing
28 pickup truck fender
30 antenna base
32 antenna feedline
34 antenna
36 tailgate

DETAILED DESCRIPTION—PREFERRED EMBODIMENT

Figure 2:
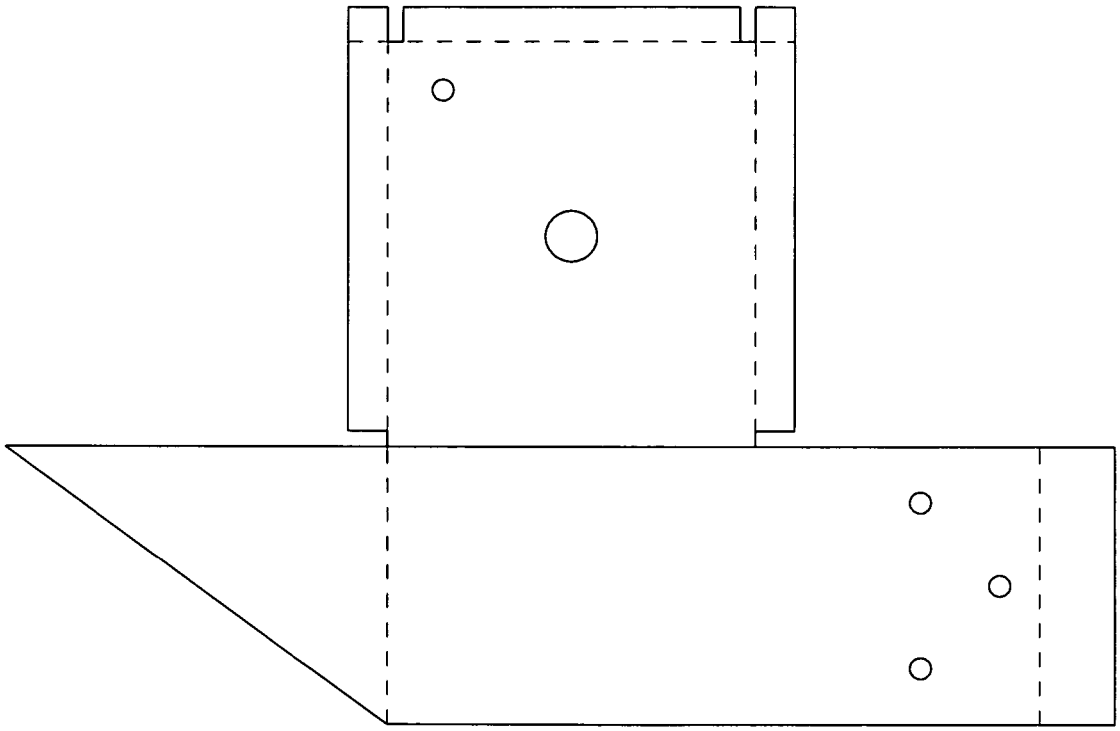
FIG. 2 is a plan view of the antenna mounting bracket which can be made from a single piece of conductive material.

FIG. 1 shows the mounting bracket as it would be fabricated in order to mount a communications antenna to the left side, i.e., driver's side, of the bed of a pickup truck. FIG. 2 shows the plan view. The bracket is comprised of four distinct sections: a platform (10A), a leg (10B), a foot (10C), and a gusset plate (10D).

The bracket (10) is made from a sheet of high-strength steel about 0.1-inch in thickness. The piece of material is cut and bent into the particular shape shown. The platform (10A) is about 4-inches on a side and has a lip (10E) of about ⅜-inches on three sides to provide additional rigidity. The leg (10B) is about 6-inches in length and 2-inches in width and must be long enough so that the platform (10A) will be located behind the rear fender of the truck when the foot (10C) rests against a rear stake pocket housing, which is an integral part of the pickup truck's bed. Three small holes (14) in the leg (10B) are provided to pass sheet-metal screws that will allow the bracket to be attached to the truck's bed. The gusset plate (10D) is welded or otherwise attached to the lip (10E) along the rear edge of the platform (10A). This assures that the platform will be structurally rigid. Two holes are drilled into the platform. Hole 16 accommodates an antenna base. Hole 18 accommodates a ground terminal.

DETAILED DESCRIPTION—ADDITIONAL EMBODIMENTS

One or more holes can be made in the platform to accommodate any specific style of antenna base. The number of and size of the hole or holes is dependent upon the style of the antenna base to be accommodated. For example, a ball and spring style base typically requires one large hole approximately 1-inch in diameter and three small holes approximately 3/16-inch in diameter, whereas a roof-mount style base requires a single hole of one particular size, typically, ⅜-inch, ¾-inch, or ⅞-inch in diameter.

A high-quality radio frequency ground can be achieved by adding a ground wire from the platform to the vehicle's frame ground. Typically this ground wire would be a length of insolated, stranded, 14 gauge wire. It would be attached to the platform (10A) at hole 18 and it would be routed to a convenient ground point somewhere on the vehicle's frame underneath the vehicle via the gap that naturally exists between the tail-light housing and the rear fender.

A simple but effective impedance matching network can be implemented by using hole 18 in the platform (10A). Although there are many types of matching networks from which to choose, a simple L-network performs well in most situations. The L-network consists of an inductor in series with the antenna and a capacitor connected from one side of the inductor to ground. In practice the need for a physical inductor is usually eliminated by making the antenna a little longer than normal and then connecting one end of the capacitor to the antenna and the other end of the capacitor to ground at hole 18.

The bracket can be used with a portable antenna, such as a sloped dipole, for fixed-portable operation in the field. In this embodiment, one leg of the dipole is connected to the antenna base and the other leg, the counterpoise, is connected to ground at the platform (10A) by means of hole 18.

DETAILED DESCRIPTION—ALTERNATE EMBODIMENTS

There are various ways in which the antenna mounting bracket can be manufactured in order to satisfy the needs of alternative applications, for example:

The preferred embodiment describes an antenna mounting bracket designed for mounting an antenna on the left side of a pickup truck; however, the antenna mounting bracket can be fabricated in it's mirror image which would result in a bracket that would mount on the right side, i.e., passenger side, of the bed of a pickup truck. In this embodiment, the platform (10A) would be located behind the right fender instead of the left one.

A lighter-duty version of the antenna mounting bracket can be fabricated by using a thinner material, and/or reducing the size of the platform to about 2-inches square, and/or by eliminating the gusset plate (10D). This embodiment would provide a less bulky mounting bracket but one still quite suitable for use with short and/or light-weight antennas.

A notch can be cut into the lower portion of the leg (10B) such that the leg (10B) would partially fit around as well as over the truck's tailgate latch mechanism (22). This embodiment would provide the bracket with additional strength and rigidity.

The width of the leg (10B) can be increased such that a tailgate latch mechanism could be fabricated onto the leg (10B) itself. In this embodiment the latch mechanism and the antenna mounting bracket would become one integral component.

DETAILED DESCRIPTION—OPERATION

The antenna mounting bracket described herein is a static device which is intended to securely support a wide variety of communication antennas behind and slightly above the rear fender of a pickup truck.

Figure 3:
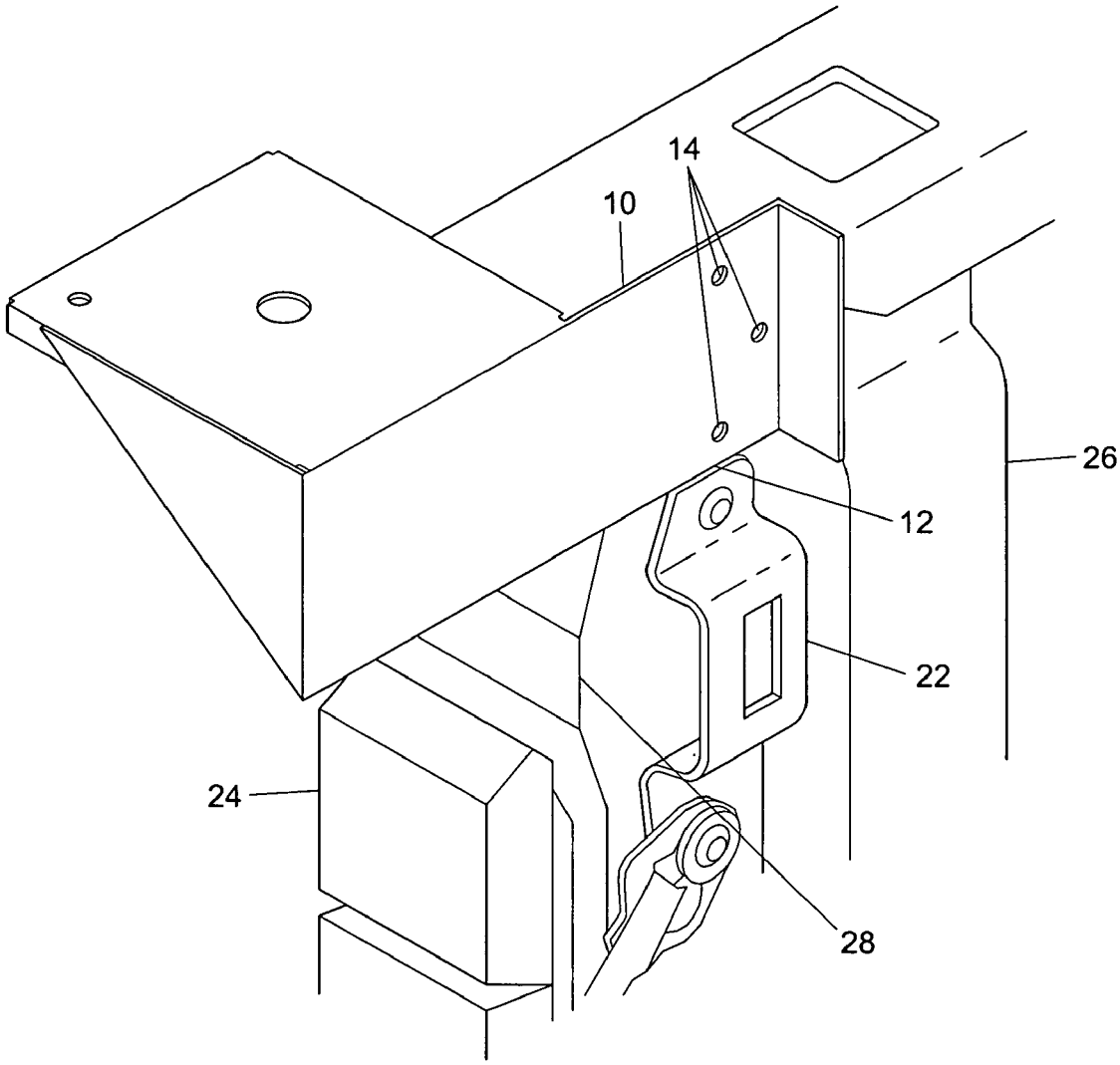
FIG. 3 is a perspective view of the antenna mounting bracket which shows the bracket installed onto the left rear fender of a pickup truck bed above the tailgate latch mechanism with the tailgate in the open position.
Figure 4:
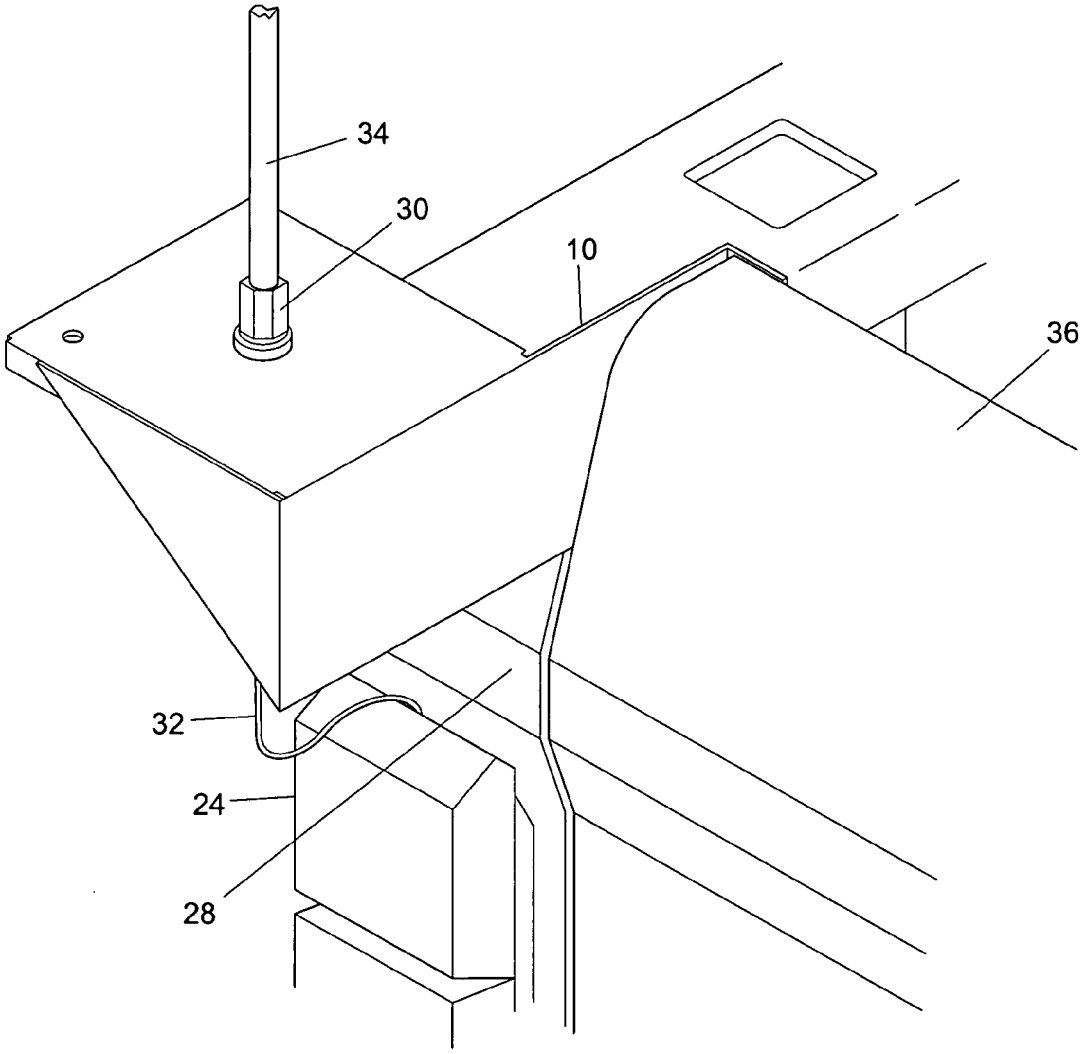
FIG. 4 is a perspective view of the antenna mounting bracket which shows the bracket installed onto the left rear fender of a pickup truck bed with the tailgate in the closed position.

Refer to FIG. 3 and FIG. 4. The antenna mounting bracket (10) is attached to the bed of a pickup truck with three sheet-metal screws via holes 14 in the leg (10B) in such a way that the following conditions are satisfied:

(a) The lower edge of the leg (10B) rests on top of the tailgate latch mechanism (22) which is an integral part of the bed.

(b) The leg (10B) passes through the naturally existing gap between the tailgate (36) and the bed so that the platform (10A) is located behind the pickup truck's rear fender (28).

(c) The front-most edge of the foot (10C) rests against the rear-most edge of the stake pocket housing (26), which is an integral part of the bed.

Once the antenna mounting bracket has been attached to the bed of the truck in the prescribed manner, an antenna base (30) is attached to the platform (10A), the antenna's feedline (32) is attached to the antenna base (30) and then routed from there to the communications equipment via the gap that naturally exists between the truck's tail-light housing (24) and the rear fender (28), and, then, a communications antenna (34) is attached to the antenna base.

If the high-quality radio frequency ground wire is used, it is attached to ground on the platform (10A) at hole 18 and then routed to the frame ground via the gap that naturally exists between the truck's tail-light housing (24) and the rear fender (28).

If the L-network matching capacitor is used, one end is attached to ground on the platform (10A) at hole 18 and the other end is connected to the antenna feed point with a short wire or metal strap.

In this configuration, the base of the antenna is located behind and slightly above the left rear fender of the pickup truck.

The vertical force produced by the weight of the antenna (34) and the antenna base (30), which is mounted on the platform (10A), is shouldered by the tailgate latch mechanism (22) not the sheet-metal screws used to attach the bracket to the bed at holes 14, and, furthermore, the point on the leg (10B) directly above the tailgate latch mechanism (22) acts as a pivot point (12) which translates the vertical force into a horizontal force that the foot (10C) transfers to the stake-pocket housing (26).

DETAILED DESCRIPTION—ADVANTAGES

From the description above, a number of advantages of my antenna mounting bracket become evident. The most significant of these advantages are:

(a) The antenna mounting bracket is structurally strong enough to support a wide variety of communications antennas including long antennas employed for use in the high-frequency, very-high-frequency, and ultra-high-frequency bands.

(b) The antenna mounting bracket causes the antenna to be located behind the rear of the bed but not beyond a vertical plane defined by the vehicle's rear bumper so that it does not protrude beyond the bumper.

(c) A communications antenna supported by this bracket is physically located behind the truck's rear fender, therefore, the antenna does not physically interfere with normal operation of the tailgate or with the installation and/or operation of accessory items commonly installed on pickup truck's, e.g., truck caps, utility racks, and so on.

(d) This method of mounting a communications antenna to a pickup truck does not require the use of one or more stake pockets; therefore, this mounting method does not preclude, prohibit, or restrict the use of widely used accessory items such as truck caps, camper conversions, ladder racks, pipe racks, or any other accessory item that mounts in or above the bed and that may or may not depend on the availability of the stake pockets for use as mounting points.

(e) A communications antenna supported by this bracket is located just above the horizontal plane created by the top of the bed rails so that performance is optimized, i.e., there is minimum distortion of the radiation field pattern, there is minimum variation in the voltage standing wave ratio when the antenna sways, and there may be additional gain resulting from the ground plane provided by the bed surface.

(f) A communications antenna supported by this bracket, especially the critically important lower portion of it, is located in the clear so it is not adversely affected by the effect of incidental capacitance due to the proximity of the antenna to the vehicle's body panels.

(g) A communications antenna supported by this bracket is located as far as is practically possible from radio frequency interference caused by the vehicle's engine and on-board computer; therefore, the potential for interference between the vehicular systems and the communications equipment is minimized.

(h) The antenna mounting bracket does not require a large hole be made in any outer body panel of the truck. In addition, the bracket is attached to the bed with unobtrusive sheet-metal screws which are concealed between the tailgate (36) and inside rear fender.

(i) The antenna mounting bracket is robust enough to easily accommodate all of the conventional antenna base styles currently in use including: ⅜-24 ball and spring, threaded stud, PL-259, SO-239, BNC, NMO, ⅜-inch, ¾-inch, and ⅞-inch surface, i.e., roof and cowl, mounts.

(j) By mounting one antenna mounting bracket to the left side of the bed and another one, which is a mirror image of the first, to the right side of the bed, two communication antennas could be mounted on the bed of the same pickup truck.

(k) By using the tailgate latch mechanism as a pivot point, the weight of the antenna is not born by the bracket mounting screws but instead by the stake-pocket housing.

The antenna mounting bracket described in this document allows a wide variety of communication antennas to be attached to the bed of a pickup truck. The particular design of this bracket has several distinct advantages including, but not limited to, those described above.

DETAILED DESCRIPTION—CONCLUSIONS, RAMIFICATIONS, AND SCOPE

From a performance point of view, the antenna mounting bracket provides a method of mounting a communications antenna to a pickup truck such that the antenna is mounted in the clear behind the bed so that the radiation field pattern and the voltage standing wave ratio are not adversely affected by stray capacitance and so that radio frequency interference from an on-board computer is minimized.

From a mechanical point of view, the antenna mounting bracket provides a method of mounting a communications antenna to a pickup truck without regard to the style of antenna or style of the antenna base. The antenna does not interfere with the operation of the tailgate (36), truck cap, camper conversion, utility rack, etc. The bracket is robust enough to support long antennas commonly used at in the high-frequency band.

From a cosmetic point of view, an unsightly hole, which would depreciate the value of the vehicle, is not required. The unobtrusive bracket mounting screws are concealed between the tailgate (36) and the inside of the bed.

Accordingly it is evident that the antenna mounting bracket described herein provides a new and unique way of securely mounting a wide variety of communications antennas to pickup trucks in such a way that optimizes performance, is consistent with the use of other commonly used accessory items frequently used with pickup trucks, and whose installation does not devalue the vehicle.

Although the description above contains may specificities, these should not be construed as limiting the scope of the invention but as merely providing illustrations of some of the presently preferred embodiments of this invention. Thus the scope of the invention should be determined by the appended claims and their legal equivalent, rather than by the examples given.

I claim:

1. A bracket for mounting an antenna to a bed of a pickup truck comprising:

(a) a rigid horizontal platform of sufficient size to accommodate a particular antenna base, ground terminal, and impedance matching capacitor, connected along one side to (b) a rigid vertical leg of sufficient length such that the platform is located behind a rear fender of the pickup truck, and (c) a vertical foot located at the end of the leg opposite the platform and on the opposite side of the leg from the platform, and (d) a plurality of holes in the leg for the means of attaching the bracket to the bed of the pickup truck, whereby a wide variety of antenna bases can be mounted to the bed of the pickup truck in such a way that the antenna will be located behind and above the rear fender so that antenna performance is optimized, a wide variety of antennas styles can be employed, physical interference with widely used truck accessories is avoided, and the cosmetic appearance of the truck body is not significantly diminished.

2. The bracket of claim 1 wherein said bracket is composed of a high-strength steel.

3. The bracket of claim 1 wherein the platform is reenforced by a gusset plate so that it can support long or heavy antennas.

4. The bracket of claim 1 wherein a notch is cut into a lower edge of the leg so that the leg can partially surround a tailgate latch mechanism.

5. The bracket of claim 1 wherein a tailgate latch mechanism is incorporated onto the leg itself.

6. The bracket of claim 1 wherein the bracket is scaled down in size and thickness for use with small, light-weight antennas rather than longer and/or heavier ones.

7. The bracket of claim 6 wherein a gusset plate is not used.

* * * * *